US009565977B2

(12) United States Patent
Harris

(10) Patent No.: US 9,565,977 B2
(45) Date of Patent: Feb. 14, 2017

(54) DISPENSERS AND REFILL UNITS HAVING COLLAPSIBLE OUTLET TUBES

(71) Applicant: GOJO Industries, Inc., Akron, OH (US)

(72) Inventor: Donald R. Harris, Tallmadge, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 14/606,680

(22) Filed: Jan. 27, 2015

(65) Prior Publication Data

US 2015/0208877 A1 Jul. 30, 2015

Related U.S. Application Data

(60) Provisional application No. 61/931,998, filed on Jan. 27, 2014.

(51) Int. Cl.

| | |
|---|---|
| ***B67D 1/00*** | (2006.01) |
| ***A47K 5/12*** | (2006.01) |
| ***B05B 11/00*** | (2006.01) |
| ***A47K 5/14*** | (2006.01) |
| *B65D 47/20* | (2006.01) |
| *B65D 37/00* | (2006.01) |
| *B65D 47/06* | (2006.01) |

(52) U.S. Cl.

CPC ..... *A47K 5/1211* (2013.01); *A47K 5/14* (2013.01); *B05B 11/007* (2013.01); *B05B 11/3053* (2013.01); *A47K 5/1208* (2013.01); *A47K 5/1217* (2013.01); *B65D 37/00* (2013.01); *B65D 47/066* (2013.01); *B65D 47/2006* (2013.01)

(58) Field of Classification Search

CPC ..... B65D 47/065–47/066; B65D 47/068; B65D 3/0041; B65D 3/0045; B65D 37/00; B65D 47/2006; B05C 5/0225; B05C 5/0229; A47K 5/1204; A47K 5/1207

USPC ..... 222/207, 212–215, 504, 526–539, 333, 222/63

See application file for complete search history.

(56) References Cited

U.S. PATENT DOCUMENTS

| | | | | |
|---|---|---|---|---|
| 2,466,899 A | | 4/1949 | Kincaid | |
| 2,858,052 A | | 10/1958 | Costakos | |
| 3,101,871 A | * | 8/1963 | Lucas | D06F 39/026 222/185.1 |
| 3,918,617 A | * | 11/1975 | Gregg | B65G 11/206 222/536 |

(Continued)

FOREIGN PATENT DOCUMENTS

| | | |
|---|---|---|
| DE | 4211494 A1 | 10/1993 |
| EP | 1516675 A2 | 3/2005 |

*Primary Examiner* — J. Casimer Jacyna
*Assistant Examiner* — Andrew P Bainbridge
(74) *Attorney, Agent, or Firm* — Calfee, Halter & Griswold LLP

(57) ABSTRACT

Exemplary dispensers and refill units having collapsible outlet tubes are disclosed herein. An exemplary refill unit includes a container, a pump having an outlet that is movable in a reciprocating motion and a flexible tube. A first end of the flexible tube is in fluid communication with the outlet of the pump and a second end connectable to a dispenser. When the second end is connected to a dispenser, the second end is stationary and movement of the pump outlet away from the second end causes the pump to dispense fluid and movement of the pump outlet toward the second end causes the flexible tube to collapse.

18 Claims, 2 Drawing Sheets

(56) References Cited

U.S. PATENT DOCUMENTS 4,063,706 A * 12/1977 Osborne, Sr. ..... F16K 7/068 24/131 R
4,174,057 A 11/1979 Emery
4,240,570 A 12/1980 Brown et al.
4,373,647 A * 2/1983 Hollingsworth ..... B67D 3/00 222/105
4,505,409 A 3/1985 Armstrong
4,513,885 A * 4/1985 Hogan ..... G01F 11/125 222/105
4,753,371 A * 6/1988 Michielin ..... F16K 7/068 138/119
5,165,577 A 11/1992 Ophardt
5,282,552 A 2/1994 Ophardt
5,373,970 A 12/1994 Ophardt
5,431,309 A 7/1995 Ophardt
5,489,044 A 2/1996 Ophardt
5,676,277 A 10/1997 Ophardt
5,836,482 A 11/1998 Ophardt et al.
5,975,360 A 11/1999 Ophardt et al.
6,053,370 A 4/2000 Ludbrook et al.
6,409,050 B1 6/2002 Ophardt
6,446,840 B2 9/2002 Ophardt
6,540,157 B2 4/2003 Ophardt
6,543,653 B2 * 4/2003 Lamboux ..... B05B 11/0037 222/321.8
6,557,736 B1 5/2003 Ophardt
6,601,736 B2 8/2003 Ophardt et al.
6,824,020 B1 11/2004 Petit
6,957,751 B2 10/2005 Ophardt
7,198,175 B2 4/2007 Ophardt
7,225,948 B2 6/2007 Ophardt et al.
7,267,251 B2 9/2007 Ophardt
7,270,250 B2 9/2007 Jones et al.
7,303,099 B2 12/2007 Ophardt
7,337,930 B2 3/2008 Ophardt et al.
RE40,319 E 5/2008 Ophardt et al.
7,621,426 B2 * 11/2009 Reynolds ..... A47K 5/1217 116/205
8,002,150 B2 8/2011 Ophardt et al.
8,251,075 B2 * 8/2012 Breese ..... A45D 34/04 132/299
8,272,539 B2 9/2012 Ophardt et al.
8,387,834 B2 * 3/2013 Proper ..... A47K 5/1207 222/181.3
2002/0015617 A1 2/2002 Schwenkel et al.
2002/0158085 A1 10/2002 Ophardt et al.
2005/0161476 A1 7/2005 Ophardt
2005/0205600 A1 9/2005 Ophardt
2006/0032871 A1 2/2006 Ophardt et al.
2006/0175354 A1 8/2006 Ophardt
2006/0237483 A1 10/2006 Ophardt
2006/0249538 A1 11/2006 Ophardt
2006/0261092 A1 11/2006 Ophardt
2006/0278659 A1 12/2006 Lin
2007/0145077 A1 6/2007 Harrold
2007/0257064 A1 11/2007 Ophardt
2007/0284394 A1 12/2007 Ophardt
2009/0230151 A1 9/2009 Ciavarella
2012/0090628 A1 * 4/2012 Turner ..... A61M 15/009 131/273

* cited by examiner

DISPENSERS AND REFILL UNITS HAVING COLLAPSIBLE OUTLET TUBES

RELATED APPLICATIONS

This application claims priority to and the benefits of U.S. Provisional Patent Application Ser. No. 61/931,998 filed on Jan. 27, 2014 and entitled "DISPENSERS AND REFILL UNITS HAVING COLLAPSIBLE OUTLET TUBES," which is incorporated herein by reference in its entirety.

TECHNICAL FIELD

The present invention relates generally to liquid dispenser systems and more particularly to dispensers and refill units that have collapsible outlet tubes.

BACKGROUND OF THE INVENTION

Liquid dispenser systems, such as liquid soap and sanitizer dispensers, provide a user with an amount of liquid upon actuation of the dispenser. Often times after a dispenser dispenses a dose of fluid, and in particular, fluid in the form of foam, and the user moves her hands away from the outlet, residual liquid or foam drips from the outlet nozzle. In addition, fluid often dries in the outlet of dispensers and refill units that are not used frequently due to air contacting the residual fluid in the outlet. Embodiments of the present invention provide an economical solution that prevents or minimizes dripping and drying out of residual fluid in the outlet.

SUMMARY

Exemplary dispensers and refill units having collapsible outlet tubes are disclosed herein. An exemplary refill unit includes a container, a pump having an outlet that is movable in a reciprocating motion and a flexible tube. A first end of the flexible tube is in fluid communication with the outlet of the pump and a second end connectable to a dispenser. When the second end is connected to a dispenser, the second end is stationary and movement of the pump outlet away from the second end causes the pump to dispense fluid and movement of the pump outlet toward the second end causes the flexible tube to collapse.

Another exemplary refill unit includes a container, a pump having an outlet that moves in an upward motion to dispense fluid and moves to a downward position during a resting state. The exemplary refill unit includes a flexible tube. A first end of the flexible tube connected to the outlet of the pump and a second end connectable to a dispenser. When the second end is connected to a dispenser, the second end is stationary movement of the pump outlet away from the second end opens a path through the flexible tube to dispense fluid and movement of the pump outlet toward the second end causes the flexible tube to close.

An exemplary dispenser includes a housing, an actuator, a container, a pump and a flexible tube. The pump has an outlet that is movable in an upward motion to dispense fluid and moves to a downward position during a resting state. A first end of the flexible tube connected to the outlet of the pump and a second end connectable to a stationary portion of the housing. Movement of the pump outlet away from the second end opens a path through the flexible tube to dispense fluid and movement of the pump outlet toward the second end causes the flexible tube to pinch itself closed in one or more locations.

BRIEF DESCRIPTION OF THE DRAWINGS

These and other features and advantages of the present invention will become better understood with regard to the following description and accompanying drawings in which.

DETAILED DESCRIPTION

Figure 1:
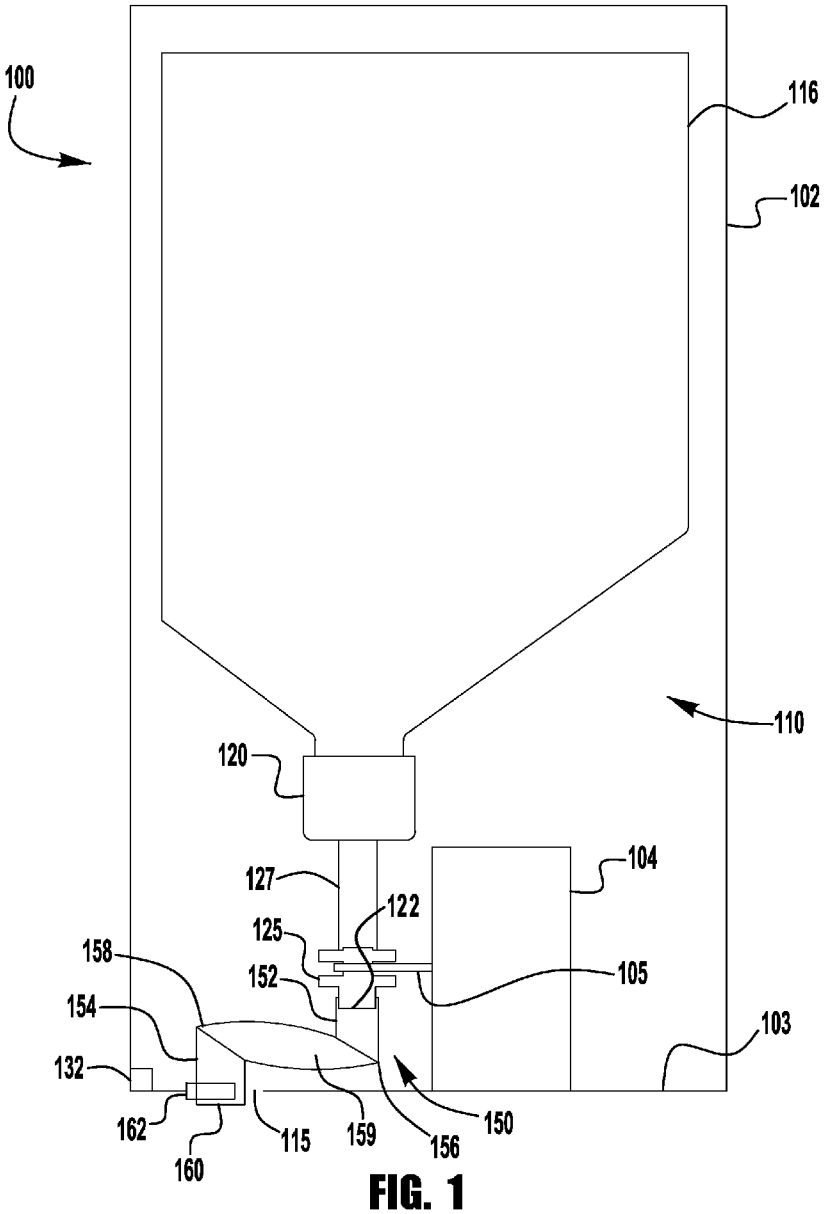
FIG. 1 is a cross-sectional view of an exemplary liquid dispenser having a refill unit with a flexible outlet tube collapsed in a resting state.

FIG. 1 illustrates an exemplary embodiment of a dispenser 100. The cross-section of FIG. 1 is taken through the housing 102 to show the pump 120 and container 116. Dispenser 100 includes a disposable refill unit 110. The disposable refill unit 110 includes a container 116 connected to pump 120 and a flexible outlet tube 150. The dispenser 100 may be a wall-mounted system, a counter-mounted system, an un-mounted portable system movable from place to place or any other kind of liquid dispenser system. In some embodiments, dispenser 100 is a foam dispenser and pump 120 is a foam pump. Exemplary foam pumps are disclosed in U.S. Pat. No. 8,272,539 filed on Dec. 3, 2008 and entitled Angled Slot Foam Dispenser, which is incorporated herein by reference in its entirety. In some embodiments, pump 120 is a liquid pump. An exemplary liquid pump is disclosed in U.S. Pat. No. 8,002,150 filed on Jul. 30, 2007 and entitled Split Engagement Flange For Soap Dispenser Pump Piston, which is incorporated herein by reference in its entirety. Although the pumps shown and disclosed herein have an outlet the moves vertically, pumps having outlets that move horizontally may also be used with the inventive concepts disclosed herein.

The container 116 forms a liquid reservoir that contains a supply of foamable liquid within the disposable refill unit 110. In various embodiments, the contained liquid could be, for example, a soap, a sanitizer, a cleanser, a disinfectant. In the exemplary disposable refill unit 110, the container 116 is a non-collapsible container and can be made of thin plastic or like material. The container 116 may advantageously be refillable, replaceable or both refillable and replaceable.

In the event the liquid stored in the container 116 of the installed disposable refill unit 110 runs out, or the installed refill unit 110 otherwise has a failure, the installed refill unit 110 may be removed from the foam dispenser 100. The empty or failed disposable refill unit 110 may then be replaced with a new disposable refill unit 110.

The housing 102 of the dispenser 100 contains one or more actuating members 104 to activate the pump 120. As used herein, actuator or actuating members or mechanisms include one or more parts that cause the dispenser 100 to move liquid, air or foam. Actuator 104 is generically illustrated because there are many different kinds of pump actuators which may be employed in the foam dispenser 100. The actuator 104 of the foam dispenser 100 may be any type of actuator such as, for example, a manual lever, a manual pull bar, a manual push bar, a manual rotatable crank, an electrically activated actuator or other means for actuating the pump 120. Electronic actuators may additionally include a sensor 132 for detecting the presence of an object and to provide for a hands-free dispenser system with touchless operation. Various intermediate linkages, such as for example linkage 105, connect the actuator member 104 to the pump 120 within the system housing 102. An aperture 115 is located in bottom plate 103 of housing 102 and allows liquid dispensed from the nozzle 125 of pump 120 to be dispensed to a user.

Dispenser housing 102 includes a tube retention member 162. Tube retention member 162 may be any type of retention member that provides for a releasable connection to flexible outlet tube 150. In the exemplary embodiment, tube retention member 162 is a c-shaped spring clip.

Flexible tube 150 may be made of a flexible material, such as, for example, polypropylene, styrene, vinyl, cellophane, water resistant paper, polyethylene, latex, santoprene, thermoplastic rubber, natural rubber, synthetic rubber, silicone, and the like. In some embodiments, flexible tube 150 is made of material that is similar to the material used to make drinking straws. In some embodiments, flexible tube 150 is made of an elastomer. Flexible tube 150 has a thin wall. In some embodiments the thin wall has a thickness of between about 0.0005 and about 0.090 inches.

Flexible tube 150 includes a first end 152 that is connected to, and in fluid communication with, the outlet 122 of pump 120. Flexible tube 150 may be connected to outlet 122 by any means, such as, for example, a friction fit, and adhesive, welding, and the like. In addition, an intermediary part (not shown) may be used to connect end 152 to outlet 122. In addition, flexible tube 150 has a second end 154 that is connectable to retention member 162 of housing 102. In this exemplary embodiment, fitting 160 is secured to second end 154 of flexible tube 150. Fitting 160 is a rigid plastic fitting that releasably snaps into and out of the spring clip. In some embodiments, fitting 160 has a barb (not shown) for connecting to second end 154 of flexible outlet tube 150. In addition, in some embodiments, fitting 160 includes one or more ridges (not shown) that are located on a side of the retention member 162 to prevent fitting 160 from pulling up out of retention member 162 or down through retention member 162.

As illustrated in FIG. 1, actuator 1054 is in its downward most position, or in its rest state. When actuator 104 is in is downward most position, flexible tube 150 is in a collapsed state. In the collapsed state of this exemplary embodiment, flexible tube 150 has two pinch points 156, 158 where the flexible tube 150 is collapsed. The two pinch points 156, 158 define a reservoir 159 there between in which residual fluid in the flexible tube 150 is trapped. The two pinch points 156, 158 seal off the outlet 122 of pump 120 from the atmosphere and prevent or limit drying of residual fluid in the outlet. In some embodiments, more than two pinch points are created. In some embodiments, only one pinch point is created in the rest state. In some embodiments, the one or more pinch points occur at a predetermined flex point(s).

Figure 2:
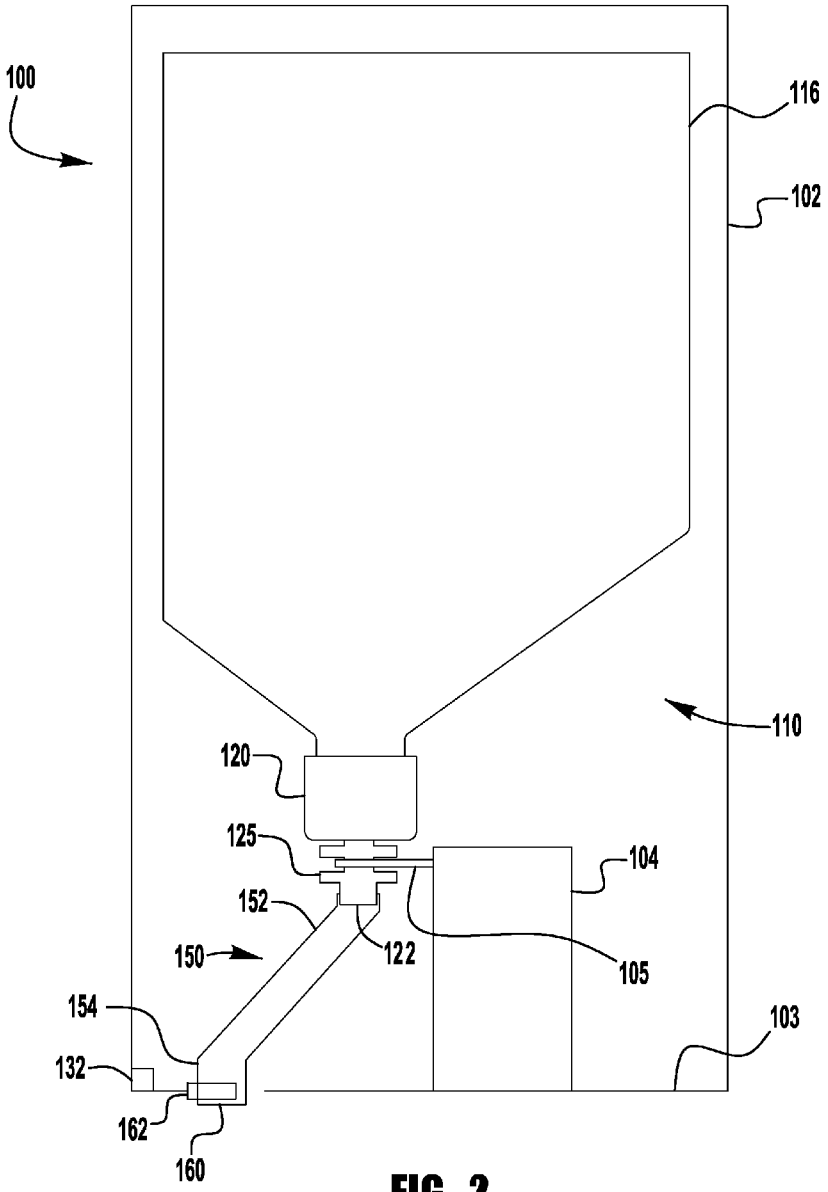
FIG. 2 is a cross-sectional view of the exemplary liquid dispenser having a refill unit with the flexible outlet tube expanded in a dispensing state.

FIG. 2 illustrate pump 120 in a dispensing or dispensed state with actuator 104 in its upward most position. In this position, flexible tube 150 is substantially straight.

In addition to preventing drying of residual fluid and dripping, in some embodiments, flexible tube 150 is at an angle when it is extended. Accordingly, flexible tube 150 allows fluid that is dispensed out of the second end 154 of flexible tube 150 to be offset from the outlet 122 of pump 120. The offset outlet of second end 154 allows for better positioning of the fluid on a user's hand. For example, the outlet of second end 154 may be further away from the back of dispenser 100 than would be possible if the fluid was simply dispensed out of outlet 122.

During operation, actuator 104 drives linkage 105 which engages engagement member 125 and moves the piston 127 upward. Outlet 122 of pump 120 also moves upward straightening out flexible tube 150. Fluid in pump 120 is forced out of outlet 122 and through flexible tube 150 and is dispensed out of second end 154. When actuator 104 moves downward, flexible tube 150 bends or creases at pinch points 156, 158 sealing off reservoir 159 and outlet 122. Because flexible tube 150 is part of refill unit 110, the flexible tube 150 need only flex and pinch enough times to dispense the contents of the refill unit 110 and then it is replaced. Thus, material fatigue and cracking of flexible tube 150 avoided. In some embodiments, the flexible tube stretches during movement of the pump outlet away from the second end 160 of the flexible tub 150.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus and illustrative examples shown and described. Accordingly, departures may be made from such details without departing from the spirit or scope of the applicant's general inventive concept.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus and illustrative examples shown and described. Accordingly, departures may be made from such details without departing from the spirit or scope of the applicant's general inventive concept.

I claim:

1. A refill unit comprising:
a container;
a pump;
the pump having a pump outlet;
the pump outlet movable in a reciprocating motion; and
a flexible tube;
wherein a first end of the flexible tube is in fluid communication with the pump outlet and a second end of the flexible tube selectively connects to a dispenser housing;
wherein when the second end of the flexible tube is connected to a dispenser housing, the second end is stationary; and
wherein movement of the pump outlet away from the second end of the flexible tube causes fluid to dispense and movement of the pump outlet toward the second end causes the flexible tube to collapse;
wherein when the pump outlet moves to dispense fluid, the first end of the flexible tube is offset vertically and is offset horizontally from the second end of the flexible tube.

2. The refill unit of claim 1 wherein when the flexible tube collapses it has at least one pinch point sealing the pump outlet from the second end of the flexible tube.

3. The refill unit of claim 1 wherein when the flexible tube collapses it has at least two pinch points sealing the pump outlet from the second end of the flexible tube.

4. The refill unit of claim 1 wherein the reciprocating motion of the pump outlet is upward and downward.

5. The refill unit of claim 4 wherein upward movement of the pump outlet causes fluid to dispense.

6. The refill unit of claim 1 wherein the flexible tube comprises an elastomer.

7. The refill unit of claim 1 wherein the flexible tube includes at least one predetermined flex point.

8. The refill unit of claim 1 wherein the flexible tube includes at least two predetermined flex points.

9. The refill unit of claim 1 wherein the flexible tube stretches during movement of the pump outlet away from the second end of the flexible tube.

10. The refill unit of claim 1 further comprising a first portion at the second end of the flexible tube that is more rigid than a second portion of the flexible tube.

11. The refill unit of claim 10 wherein the first portion at the second end of the flexible tube is a different material than the second portion of the flexible tube.

12. The refill unit of claim 1 wherein movement of the pump outlet towards the second end of the flexible tube causes the flexible tube to pinch to a closed position in one or more predetermined points.

13. The refill unit of claim 1 wherein when the pump outlet moves to dispense fluid, the flexible tube extends at an axis that does not extend along a horizontal axis and does not extend along a vertical axis.

14. The refill unit of claim 1 wherein when the pump outlet moves to a rest position, the flexible tube forms a reservoir between a pair of pinch points.

15. A refill unit comprising:

a container;

a pump;

the pump having a pump outlet;

the pump outlet moves in an upward motion to dispense fluid and moves to a downward position during a resting state; and a flexible tube;

a first end of the flexible tube connected to the pump outlet;

a second end of the flexible tube that selectively connects to a dispenser housing;

wherein when the second end of the flexible tube is connected to a dispenser housing, the second end is stationary; and wherein movement of the pump outlet away from the second end of the flexible tube opens a path through the flexible tube to dispense fluid and movement of the pump outlet toward the second end causes the flexible tube to close;

wherein when the pump outlet moves to dispense fluid, the flexible tube extends at an axis that does not extend along a horizontal axis and does not extend along a vertical axis.

16. A dispenser comprising:

a dispenser housing;

an actuator;

a container;

a pump;

the pump having a pump outlet;

the pump outlet moves in an upward motion to dispense fluid and moves to a downward position during a resting state; and a flexible tube;

a first end of the flexible tube connected to the pump outlet;

a second end of the flexible tube that selectively connects to a stationary portion of the dispenser housing;

wherein movement of the pump outlet away from the second end of the flexible tube opens a path through the flexible tube to dispense fluid and movement of the pump outlet toward the second end causes the flexible tube to pinch to a closed position in one or more locations;

wherein when the pump outlet moves to the upward most position, the first end of the flexible tube is offset vertically and is offset horizontally from the second end of the flexible tube.

17. The dispenser of claim 16 wherein the flexible tube pinches to a closed position in one or more predetermined points.

18. The dispenser of claim 16 wherein when the pump outlet moves to a rest position, at least a pair of pinch points are formed in the flexible tube and a reservoir is formed between the pair of pinch points.

* * * * *